US005952980A

United States Patent [19]

Boling

[11] Patent Number: 5,952,980

[45] Date of Patent: Sep. 14, 1999

[54] LOW PROFILE ANTENNA POSITIONING SYSTEM

[75] Inventor: Kenneth A. Boling, Conway, Ark.

[73] Assignee: BEI Sensors & Motion Systems Company, Maymelle, Ark.

[21] Appl. No.: 08/931,990

[22] Filed: Sep. 17, 1997

[51] Int. Cl.[6] ..... H01Q 3/03; H01Q 3/08

[52] U.S. Cl. ..... 343/766; 343/766; 343/765; 318/352

[58] Field of Search ..... 343/766, 765, 343/757, 705, 882, 894, 880; 318/352; 248/515

[56] References Cited

U.S. PATENT DOCUMENTS

| | | | |
|---|---|---|---|
| 2,907,031 | 9/1959 | Meredith | 343/757 |
| 3,530,477 | 9/1970 | Jarrett et al. | 343/765 |
| 3,734,591 | 5/1973 | Howe | 350/6 |
| 3,860,930 | 1/1975 | Peterson | 343/788 |
| 4,126,865 | 11/1978 | Longhurst et al. | 343/766 |
| 4,802,640 | 2/1989 | Reid | 244/3.19 |
| 4,834,329 | 5/1989 | Delapp | 343/882 |
| 4,875,052 | 10/1989 | Anderson et al. | 343/878 |
| 4,931,809 | 6/1990 | Putnam et al. | 343/882 |
| 5,000,408 | 3/1991 | Bourgeois et al. | 248/103 |
| 5,025,262 | 6/1991 | Abdelrazik et al. | 343/705 |
| 5,153,485 | 10/1992 | Yamada et al. | 318/35 |
| 5,389,940 | 2/1995 | Sutherland | 343/765 |
| 5,432,524 | 7/1995 | Sydor | 343/765 |
| 5,473,335 | 12/1995 | Tines | 343/766 |

FOREIGN PATENT DOCUMENTS

| | | |
|---|---|---|
| 57-4601 | 1/1982 | Japan . |
| 187104 | 9/1985 | Japan . |
| 2151851 | 7/1985 | United Kingdom . |

*Primary Examiner*—Don Wong
*Assistant Examiner*—James Clinger
*Attorney, Agent, or Firm*—Mark Rogers; Gary N. Speed; Mark M. Henry

[57] ABSTRACT

A low profile antenna positioning system is disclosed which has a carriage, an antenna, a first member pivotally secured to the antenna and slidably secured to the carriage and a second member pivotally secured to the antenna and pivotally secured to the carriage. The antenna is movable through a wide range of elevation angles and maintains a relatively low profile as it moves back and forth between an elevation angle of from approximately 15° to approximately 69°. In that regard, an upper portion of the antenna moves downwardly and rearwardly in a linear path and a lower portion of the antenna moves upwardly in an arcuate path as the elevation angle increases. Similarly, the upper portion of the antenna moves upwardly and forwardly in a linear path and the lower portion of the antenna moves downwardly in an arcuate path as the elevation angle decreases. The carriage may be pivotally secured to a base for movement about an azimuth axis.

22 Claims, 4 Drawing Sheets

LOW PROFILE ANTENNA POSITIONING SYSTEM

BACKGROUND OF THE INVENTION

This invention relates to an antenna positioning system, and more particularly, to low profile antenna positioning systems for controlling azimuth and elevation angles within a radome.

Antenna positioning systems have been around for as long as there have been signals to send or receive. Even the most simple communications system requires some method of pointing an antenna to obtain desired results from the system. An antenna positioning system often includes some method of pointing, varying or controlling the position of an antenna about an azimuth axis, typically a vertical axis, and about an elevation axis, typically a horizontal axis. In a common system, a yoke is pivotally secured to opposing sides of an antenna so that the antenna pivots about an elevation axis, which typically passes through the locations of pivotal attachment. The yoke is also pivotally mounted to a base directly over the azimuth axis. The yoke, and therefore the antenna, may be rotated about the azimuth axis to control the azimuth angle of the antenna, and the antenna may be rotated about the elevation axis to control the elevation angle of the antenna. Means for determining the position of the antenna relative to a base or mounting surface are often provided, together with means for actuating or moving the antenna through a range of azimuth and elevation angles. Such antenna positioning systems work well for their intended purposes and have benefits associated with their ease of construction and simplicity of operation. These antenna positioning systems are not, however, without problems. For example, these structures tend to be relatively tall, so they do not lend themselves to use in situations in which size, particularly height, is a concern.

Placing antennas within radomes on moving objects is also known. When an antenna positioning system is to be used on a moving object, such as an aircraft or vehicle, the system is typically placed within a radome which is transparent to the signal being sent or received. The radome protects the system from damage while reducing aerodynamic drag that might otherwise hinder operation of the aircraft or vehicle. Particularly when such a system is used on an aircraft, it is important to minimize the size of the radome to reduce aerodynamic drag. It is also desirable to use an antenna positioning system that provides for movement through a wide range of azimuth and elevation angles while providing the largest antenna that can be fit within the radome. Antenna positioning systems have, to date, made poor use of the volume available inside the radome. This has required unnecessarily small antennas or unnecessarily large radomes to be used. For example, if an antenna and yoke are disposed at the azimuth axis, above an azimuth motor and encoder, the radome must be quite tall to accommodate the maximum height of the antenna as it moves through a range of elevation angles. Conversely, if the antenna and yoke are moved far enough away from the azimuth axis so that the antenna may pivot about the yoke over a range of elevation angles, the antenna must be quite short because of the reducing width of the radome as one moves along a radius away from the center.

SUMMARY OF THE INVENTION

It is therefore an object of the present invention to provide an antenna positioning system that is compact yet operable over a wide range of elevation and azimuth angles.

It is a further object of the present invention to provide a system of the above type that takes advantage of the volume available inside a radome.

It is a still further object of the present invention to provide a system of the above type that may be used on an aircraft or vehicle to track a satellite while the aircraft or vehicle is in motion.

It is a still further object of the present invention to provide a system of the above type that permits the elevation angle of an antenna to be adjusted while maintaining strict height control over the antenna.

It is a still further object of the present invention to provide a system of the above type that provides for adjustment of an antenna over a wide range of elevation angles while maintaining a relatively constant antenna height.

Toward the fulfillment of these and other objects and advantages, the antenna positioning system of the present invention comprises a carriage, an antenna, a first member pivotally secured to the antenna and slidably secured to the carriage and a second member pivotally secured to the antenna and pivotally secured to the carriage. The antenna is movable through a wide range of elevation angles and maintains a relatively low profile as it moves from an elevation angle of from approximately 15° to approximately 69°. In that regard, an upper portion of the antenna moves downwardly and rearwardly in a linear path and a lower portion of the antenna moves upwardly in an arcuate path as the elevation angle increases. Similarly, the upper portion of the antenna moves upwardly and forwardly in a linear path and the lower portion of the antenna moves downwardly in an arcuate path as the elevation angle decreases. The carriage may be pivotally secured to a base for movement about an azimuth axis.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings, wherein.

DETAILED DESCRIPTION OF THE PREFERRED EMBODIMENT

Figure 1:
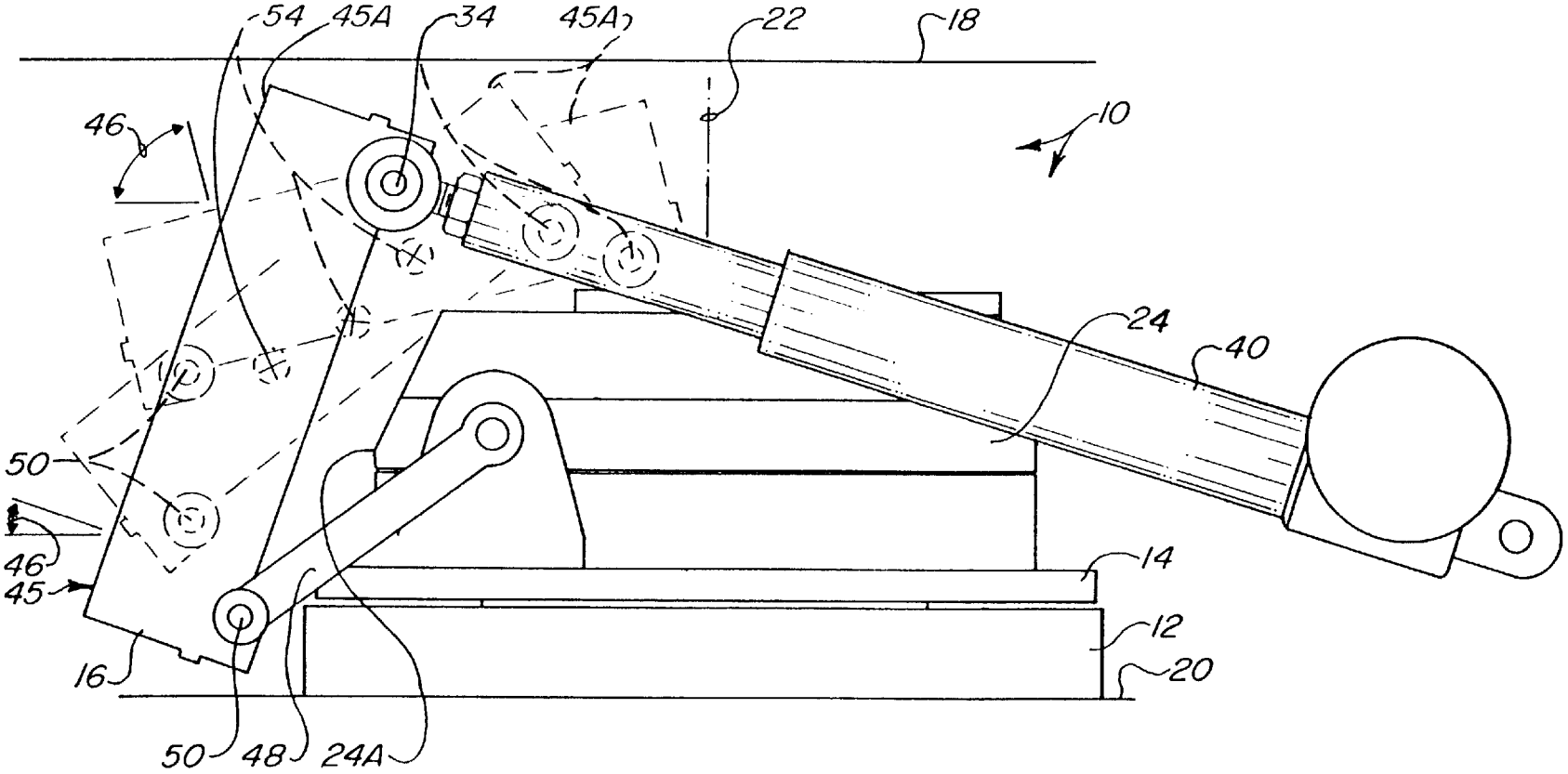
FIG. 1 is a side elevation view of an antenna positioning system of the present invention.
Figure 2:
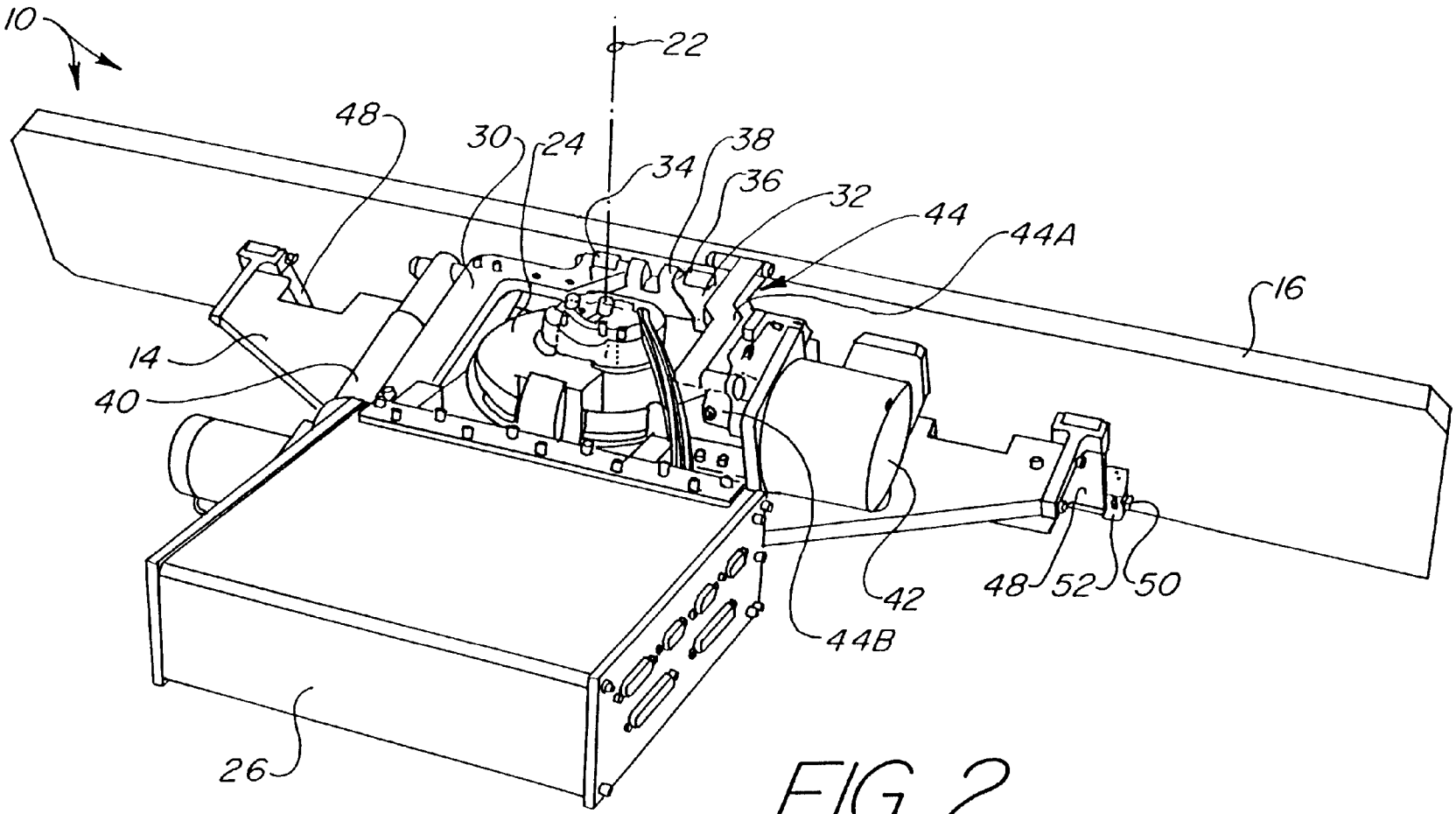
FIG. 2 is a perspective view of an antenna positioning system of the present invention.

Referring to FIG. 1, the reference numeral 10 refers in general to an antenna positioning system of the present invention, comprising a base 12, a carriage 14 and an antenna 16. The system 10 is positioned within a radome 18 that is disposed on an exterior portion of a supporting object 20 such as an aircraft or vehicle.

The base 12 is rigidly secured to the supporting object 20, such as an aircraft or vehicle. An annular opening in the base 12 permits wiring or other objects to pass from an interior portion of the supporting object 20, through the base 12 and to components secured to the carriage 14. It is understood that the base 12 may take any number of shapes or sizes and may be constructed of any number of materials.

The radome 18 is affixed to the outer surface of the supporting object 20 so that the base 12, carriage 14 and antenna 16 are housed within the radome. The radome 18 is cylindrical, having an inside diameter of approximately 35 inches and an inner height approximately 5.5 inches. It is understood that the radome 18 may be constructed of any conventional materials and may be dome shaped or may take any number of shapes or sizes.

The carriage 14 is pivotally secured to the base 12 and rotates about an azimuth axis 22. The carriage 14 is preferably rotatable at least 360° about the azimuth axis 22 relative to the base 12, is more preferably rotatable for at least several 360° revolutions in either direction about the azimuth axis 22 and is most preferably "infinitely" rotatable about the azimuth axis 22 so that there is no need to "unwind" the carriage 14 after it has been rotated several 360° revolutions in either direction. It is understood that the carriage 14 may take any number of shapes or sizes and may be constructed of any number of materials.

Figure 5:
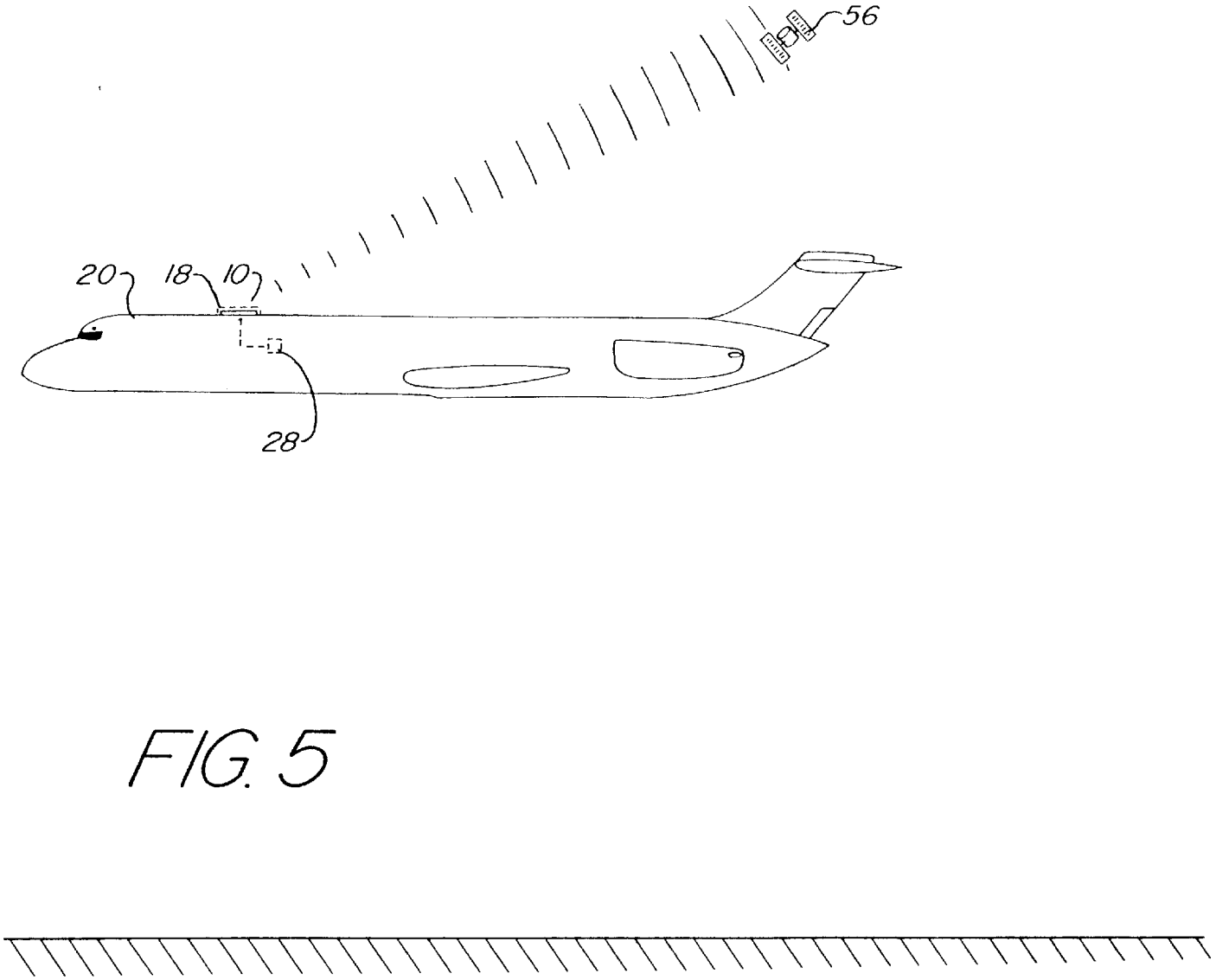
FIG. 5 is a schematic view of an aircraft having an antenna positioning system of the present invention.

An azimuth motor and encoder 24 having an internally mounted slip ring assembly is secured to the carriage 14 and is disposed directly over the azimuth axis 22 so that a central axis of the azimuth motor and encoder 24 is aligned with the azimuth axis. An enclosure 26 for housing system electronics is secured to the carriage 14 rearward of azimuth motor and encoder 24. As shown in FIG. 5, additional system controls 28 may be housed in the interior of the supporting object 20.

Figure 3:
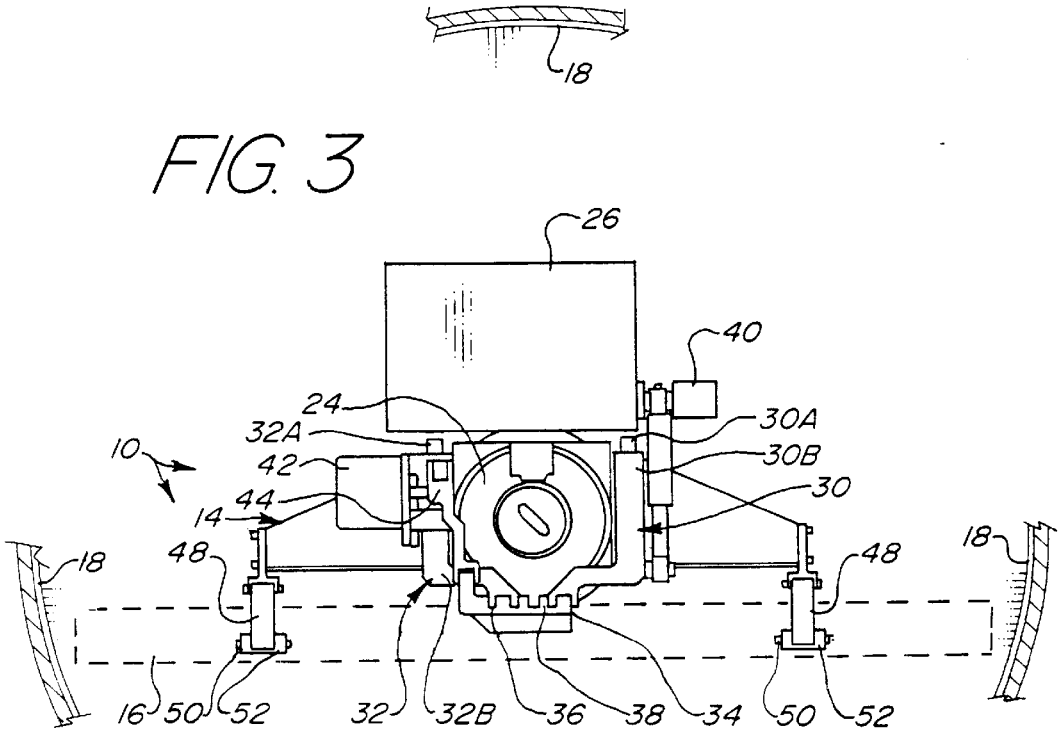
FIG. 3 is a top, partially exploded view of an antenna positioning system of the present invention.

As best seen in FIG. 3, crossed roller slides 30 and 32 are also affixed to the carriage 14 on opposite sides of the azimuth motor and encoder 24. Each slide 30 and 32 has a base member 30A and 32A, respectively, that is rigidly secured to the carriage 14 and has an upper member 30B and 32B that is slidably secured to the base member 30A and 32A, respectively, such as using a dovetail type mount with crossed rollers within the base member for stability and ease of motion. A front end of each upper member 30B and 32B is pivotally secured to the antenna 16 at a location 34 and 36, respectively, by bracket 38. The base members 30A and 32A slidably support the upper members 30B and 32B at an angle of approximately 15 degrees relative to the carriage 14, and the upper members 30B and 32B have a length of travel of approximately 2.25 inches. A motorized lead screw 40 is secured at its forward end to upper member 30B and at its rear end to enclosure 26. The motorized lead screw 40 actuates or drives the slides 30 and 32, for reasons to be discussed later. It is understood that there is a great degree of flexibility in selecting the type, shape and manner of attachment of the slides 30 and 32, as well as the mounting angle and length of travel of the slides depending upon the desired design parameters. It is also understood that any conventional actuation or drive means may also be used.

Figure 4:
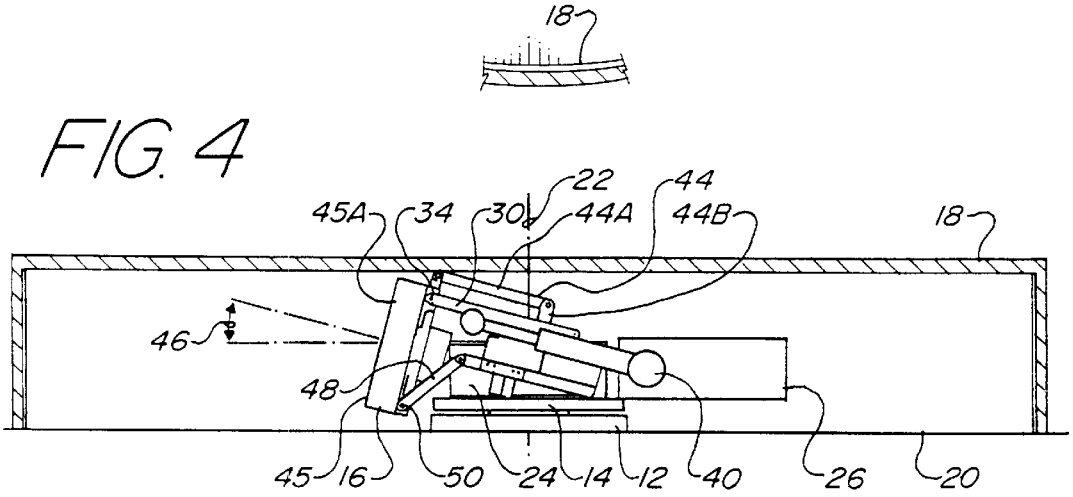
FIG. 4 is a side view of an antenna positioning system of the present invention.

An elevation encoder 42 is secured to the upper member 32B of the slide 32 and moves with the upper member. As best seen in FIGS. 3 and 4, a front portion 44A of a sensing arm 44 is pivotally secured to the antenna 16 by the bracket 38 and extends above and substantially parallel with upper member 32B. A rear portion 44B of the sensing arm is pivotally secured to the front portion and is pivotally secured to the elevation encoder 42. The front portion 44A of the sensing arm 44 has substantially the same length as the upper member 32B so that a parallelogram type of linkage permits the rear portion 44B of the sensing arm to be maintained substantially parallel with a front face 45 of the antenna 16 as the antenna moves, thus permitting a direct read of an elevation angle 46 by the elevation encoder 42. It is understood that any conventional method of sensing the elevation angle 46 may be used, including but not limited to a cable and drum drive for the elevation encoder 42 or an encoder mounted along the axis of rotation of the antenna 16 at the bracket 38. It is also understood that the elevation encoder 42 may be secured directly to the carriage 14 rather than to the upper member 32B of the slide 32.

Arms 48 having a length of approximately 2.5 inches extend between and connect the antenna 16 and carriage 14. A front end of each arm 48 is pivotally secured to the antenna 16 at a location 50, by a bracket 52. Each arm 48 is also pivotally secured at its rear end to the carriage 14. It is understood that there is a great degree of flexibility in parameters such as the lengths and locations of attachment of the arms 48.

The antenna 16 is a rectangular, flat plate antenna having a length of approximately 32 inches, a height of approximately 4.5 inches and a depth or width of approximately ¾ inches. Bracket 38 is secured to a rear face of the antenna 16 near the center of its upper edge, and brackets 52 are secured to the rear face of the antenna near its lower edge, approximately mid span between the center of the antenna and its respective sides. As best seen in FIGS. 1 and 4, the antenna 16 is supported so that the front face 45 of the antenna is aligned at a desired elevation angle 46. For the depicted flat plate antenna 16, the elevation angle 46 may be described as the angle formed between a horizontal line and a line normal to the front face 45 of the antenna. For dish antennas, an elevation axis may be described as the angle formed between a horizontal line and an axis of symmetry of the antenna.

The antenna 16 is movable through a range of elevation angles, preferably through a range of from approximately −45° to approximately 100°, more preferably from approximately 0° to approximately 90° and most preferably from about 15° to approximately 69°. As best seen in FIG. 1, the antenna 16 is offset from the azimuth axis 22 throughout its range of elevation angles. As also seen in FIG. 1, when the antenna is positioned at an elevation angle 46 of approximately 15°, the front face 45 of the antenna 16, including a point 45A on a top portion thereof, is disposed forward of the azimuth axis 22 and forward of a front edge 24A of the azimuth motor and encoder 24. When the antenna 16 is positioned at an elevation angle 46 of approximately 69°, a portion of the front face 45 of the antenna, including point 45A, is disposed forward of the azimuth axis 22 and rearward of the front edge 24A of the azimuth motor and encoder 24. Similarly, when the antenna 16 is positioned at an elevation angle 46 of approximately 15°, the center of gravity 54 of the antenna is disposed forward of the azimuth axis 22 and forward of the front edge 24A of the azimuth motor and encoder 24, and when the antenna 16 is positioned at an elevation angle 46 of approximately 69°, the center of gravity 54 of the antenna is disposed forward of the azimuth axis 22 and rearward of the front edge 24A of the azimuth motor and encoder 24. It is understood that any size or shape antenna 16 may be used and that there is a high degree of design flexibility in matters such as the range of elevation angles over which the antenna may move and the particular path over which the antenna travels as it moves through the range of elevation angles. It is also understood that the ranges of elevation and azimuth angles described herein refer to ranges of such angles when the base 12 is in a fixed orientation relative to the elevation axis and azimuth axis, respectively.

In operation, while an aircraft is in flight, the antenna 16 is pointed at a geostationary satellite 56 to receive a signal therefrom. As the aircraft moves, the antenna 16 is continuously dithered by the azimuth motor and encoder 24 and by the motorized lead screw 40, and system electronics determines where the antenna should be pointed to receive the strongest possible signal. As the azimuth angle needs adjustment to continue receiving a strong signal from the satellite 56, the azimuth motor and encoder 24 rotates the carriage 14, and therefore the antenna 16, about the azimuth axis 22 to keep the antenna pointed at the satellite 56.

As the elevation angle 46 needs adjustment to continue receiving a strong signal from the satellite 56, the motorized lead screw 40 is activated to drive the slides 30 and 32, and therefore the antenna 16, to adjust the elevation angle. If the angle of elevation needs to be increased, the lead screw 40 is retracted, moving the upper attachment locations 34 and 36 and downwardly and rearwardly over linear paths relative to the carriage 14. As the motorized lead screw 40 is retracted, the path and relative rate of movement of the lower attachment locations 50 varies, depending upon the range of elevation angles over which the antenna 16 is being moved. Over a small range of elevation angles, from approximately 15° to approximately 20°, the lower attachment locations 50 move slightly downwardly in an arcuate path relative to the carriage 14 at a relatively low rate of speed. Over the majority of the range of elevation angles, from approximately 20° to approximately 69°, the lower attachment locations 50 move upwardly in an arcuate path relative to the carriage 14 at an increased rate of speed. Because of the movement of locations 34, 36 and 50, the apparent elevation axis moves as the elevation angle 46 changes.

If the angle of elevation needs to be decreased, the motorized lead screw 40 is extended, moving the upper attachment locations 34 and 36 upwardly and forwardly over linear paths relative to the carriage 14. As the motorized lead screw 40 is extended, the path and relative rate of movement of the lower attachment locations 50 varies, depending upon the range of elevation angles over which the antenna 16 is being moved. Over the majority of the range of elevation angles, from approximately 69° to approximately 20°, the lower attachment locations 50 move downwardly in an arcuate path relative to the carriage 14 at an increased rate of speed. Over a small range of elevation angles, from approximately 20° to approximately 15°, the lower attachment locations 50 move slightly upwardly in an arcuate path relative to the carriage 14 at a relatively low rate of speed. Because of the movement of points as the elevation angle 46 changes, the apparent elevation axis moves as the elevation angle changes. Also, because of the downward movement of points 50 as the antenna 16 moves from approximately 69° to approximately 20°, the maximum height of the antenna does not increase substantially as the antenna moves through this range of elevation angles.

Other modifications, changes and substitutions are intended in the foregoing, and in some instances, some features of the invention will be employed without a corresponding use of other features. For example, the base 12, radome 18 or system electronics need not be used. Also, the angles, measurement, ranges and other quantitative data supplied are by way of example only and are not intended to limit the scope of the invention. Further, although the system 10 is described with a receiving antenna 16, it is understood that a transmitting antenna may be used. Further still, although the locations 34, 36 and 50 is said to travel in a linear path, it is understood that the location may travel in an arcuate path. Also, any number of different types of suitable linking members may be used in place of the slides 30 and 32 and arms 48. Further, although the system 10 is described as being pointed at a geostationary satellite 56, the system 10 may of course be used to point a receiving or transmitting antenna or other equipment at any number of objects. Accordingly, it is appropriate that the appended claims be construed broadly and in a manner consistent with the scope of the invention.

What is claimed is:

1. An apparatus, comprising:

a carriage;

an antenna;

a first member pivotally secured to said antenna and slidably secured to said carriage; and a second member pivotally secured to said antenna and pivotally secured to said carriage.

2. The apparatus of claim 1, further comprising a base, said carriage being pivotally secured to said base to rotate relative to said base about an azimuth axis.

3. The apparatus of claim 1, further comprising:

a third member pivotally secured to said antenna and slidably secured to said carriage; and a fourth member pivotally secured to said antenna and pivotally secured to said carriage.

4. The apparatus of claim 1 wherein said first member is pivotally secured to an upper, rear portion of said antenna, and said second member is pivotally secured to a lower, rear portion of said antenna.

5. The apparatus of claim 1 wherein said first member comprises a slide having a lower member rigidly secured to said carriage and an upper member pivotally secured to said antenna and slidably secured to said lower member.

6. The apparatus of claim 5 further comprising means for controlling movement of said upper member of said slide relative to said lower member of said slide.

7. The apparatus of claim 5 further comprising a motorized lead screw secured to said carriage and to said upper member of said slide.

8. The apparatus of claim 2 further comprising means for controlling an azimuth angle of said antenna relative to said base.

9. The apparatus of claim 2 further comprising an azimuth motor and encoder secured to said carriage.

10. The apparatus of claim 9 wherein said azimuth motor and encoder is secured to said carriage at said azimuth axis.

11. The apparatus of claim 2 wherein said antenna is offset from said azimuth axis.

12. The apparatus of claim 2 wherein said antenna is movable through a range of elevation angles, and wherein said antenna is offset from said azimuth axis throughout said range of elevation angles.

13. The apparatus of claim 2 further comprising a radome, said antenna being disposed within said radome.

14. The apparatus of claim 13 further comprising an aircraft, said radome being secured to said aircraft.

15. The apparatus of claim 1 wherein said antenna is movable through a range of elevation angles of from at least approximately 69° to at least approximately 20°, and wherein a maximum height of said antenna relative to said carriage does not increase substantially as said antenna moves from an elevation angle of approximately 69° to an elevation angle of approximately 20°.

16. An apparatus, comprising:

an antenna;

a carriage; and means for adjusting an elevation angle of said antenna, comprising:

means for moving a first location on said antenna over a linear path relative to said carriage; and means for moving a second location on said antenna over an arcuate path relative to said carriage.

17. The apparatus of claim 16, further comprising:

a base, said carriage being pivotally secured to said base to rotate relative to said base about an azimuth axis; and means for controlling an azimuth angle of said antenna.

18. The apparatus of claim 16 further comprising a radome, said antenna being disposed within said radome.

19. A method of controlling movement of an antenna, comprising:

(1) pivotally securing an antenna to a carriage at a first location;

(2) pivotally securing said antenna to said carriage at a second location;

(3) moving said first location over a linear path relative to said carriage; and (4) moving said second location over an arcuate path relative to said carriage.

20. The method of claim 19 wherein step (1) comprises pivotally securing an upper, rear portion of said antenna to said carriage at said first location, and step (2) comprises pivotally securing a lower, rear portion of said antenna to said carriage at said second location.

21. The method of claim 19 wherein:

step (3) comprises moving said first location downwardly and rearwardly over a linear path relative to said carriage; and step (4) comprises moving said second location upwardly over an arcuate path relative to said carriage.

22. The method of claim 19 wherein:

step (3) comprises moving said first location upwardly and forwardly over a linear path relative to said carriage; and step (4) comprises moving said second location downwardly over an arcuate path relative to said carriage.

* * * * *